US012331975B2

(12) United States Patent
Park et al.

(10) Patent No.: US 12,331,975 B2
(45) Date of Patent: Jun. 17, 2025

(54) REFRIGERATING SYSTEM USING NON-AZEOTROPIC MIXED REFRIGERANT

(71) Applicant: LG ELECTRONICS INC., Seoul (KR)

(72) Inventors: Yongjoo Park, Seoul (KR); Changho Seo, Seoul (KR); Kyeongyun Kim, Seoul (KR); Minho Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 550 days.

(21) Appl. No.: 17/634,917

(22) PCT Filed: Aug. 20, 2020

(86) PCT No.: PCT/KR2020/011140
§ 371 (c)(1),
(2) Date: Feb. 11, 2022

(87) PCT Pub. No.: WO2021/034134
PCT Pub. Date: Feb. 25, 2021

(65) Prior Publication Data

US 2022/0373232 A1 Nov. 24, 2022

(30) Foreign Application Priority Data

Aug. 21, 2019 (KR) ..... 10-2019-0102341

(51) Int. Cl.
*F25B 9/00* (2006.01)
*F25B 41/20* (2021.01)
*F25B 41/37* (2021.01)

(52) U.S. Cl.
CPC ..... *F25B 9/006* (2013.01); *F25B 41/20* (2021.01); *F25B 41/37* (2021.01); *F25B 2341/062* (2013.01); *F25B 2400/23* (2013.01)

(58) Field of Classification Search
CPC ..... F25B 2400/23; F25B 2600/2511; F25B 41/40; F25B 5/04; F25B 9/006
See application file for complete search history.

(56) References Cited

U.S. PATENT DOCUMENTS 10,782,048 B2 9/2020 Park et al.
2006/0137388 A1* 6/2006 Kakehashi ..... F25B 5/02 62/524

(Continued)

FOREIGN PATENT DOCUMENTS

CN 1205073 A 1/1999
CN 1723372 A 1/2006

(Continued)

*Primary Examiner* — Lionel Nouketcha
(74) *Attorney, Agent, or Firm* — Bryan Cave Leighton Paisner LLP

(57) ABSTRACT

A refrigerating system may include a compressor configured to compress a non-azeotropic mixed refrigerant, a condenser configured to condense the compressed non-azeotropic mixed refrigerant, a three-way valve configured to branch the non-azeotropic mixed refrigerant condensed by the condenser, a first evaporator configured to supply cold air to a first interior space, a second evaporator configured to supply cold air to a second interior space at a temperature higher than at a temperature of the first interior space, and a capillary tube configured to expand the non-azeotropic mixed refrigerant branched by the three-way valve and supply the expanded non-azeotropic mixed refrigerant to at least one of the first evaporator or the second evaporator. With such features, a high-efficiency refrigerating system to which the non-azeotropic mixed refrigerant is applied may be implemented.

23 Claims, 11 Drawing Sheets

(56) References Cited

U.S. PATENT DOCUMENTS

| | | | | |
|---|---|---|---|---|
| 2007/0068193 | A1* | 3/2007 | Yoon | F25B 5/00 62/199 |
| 2007/0180853 | A1 | 8/2007 | Lim et al. | |
| 2013/0327078 | A1 | 12/2013 | Junge | |
| 2015/0096325 | A1 | 4/2015 | Rivis | |
| 2019/0024948 | A1* | 1/2019 | Park | F25B 43/003 |

FOREIGN PATENT DOCUMENTS

| | | | |
|---|---|---|---|
| CN | 102401533 | A | 4/2012 |
| CN | 103148629 | A | 6/2013 |
| DE | 102015210112 | A1 | 12/2016 |
| JP | 2006-177632 | A | 7/2006 |
| KR | 20-1997-0010571 | U | 8/1997 |
| KR | 2011-0115911 | A | 11/2011 |
| KR | 10-2017-0085936 | A | 7/2017 |
| KR | 10-2018-0001058 | A | 1/2018 |
| WO | 2017123042 | A1 | 7/2017 |

* cited by examiner

【Figure 1】
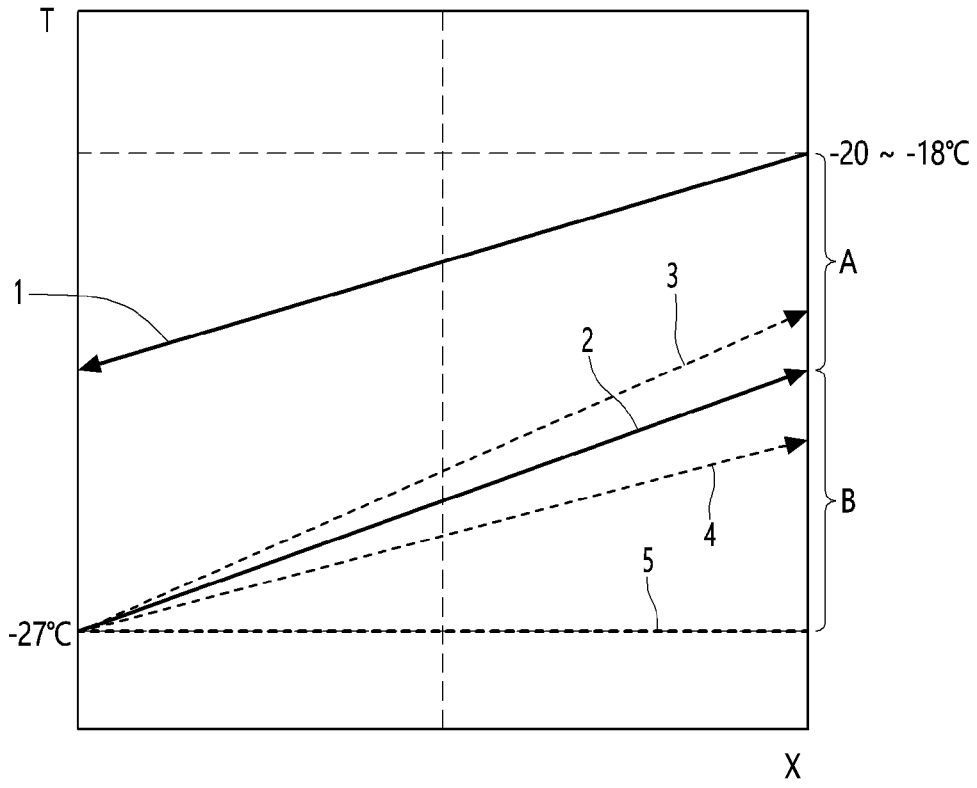

【Figure 2】
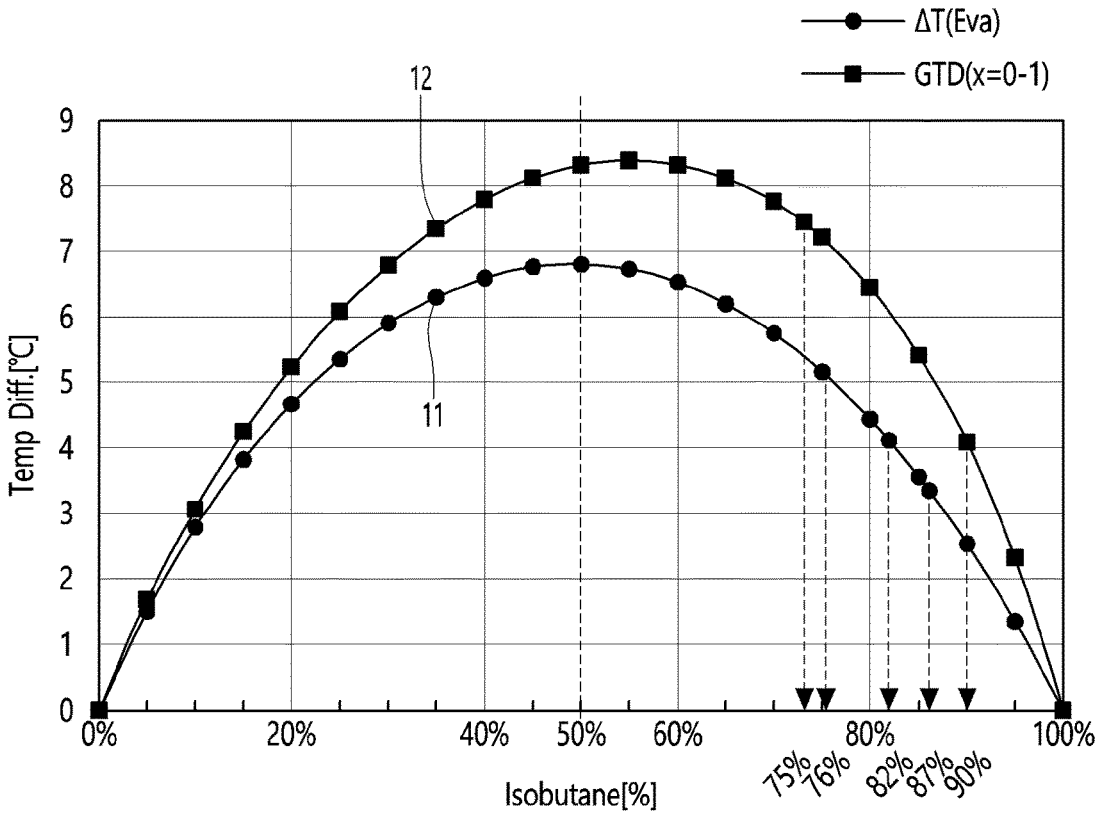

【Figure 3A】
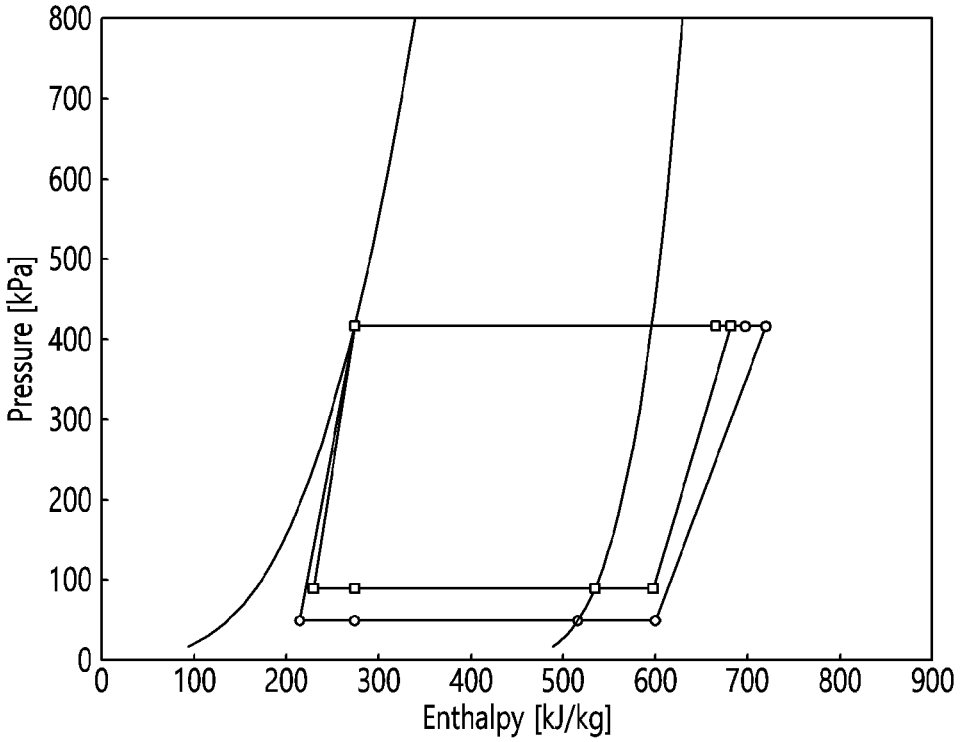

【Figure 3B】
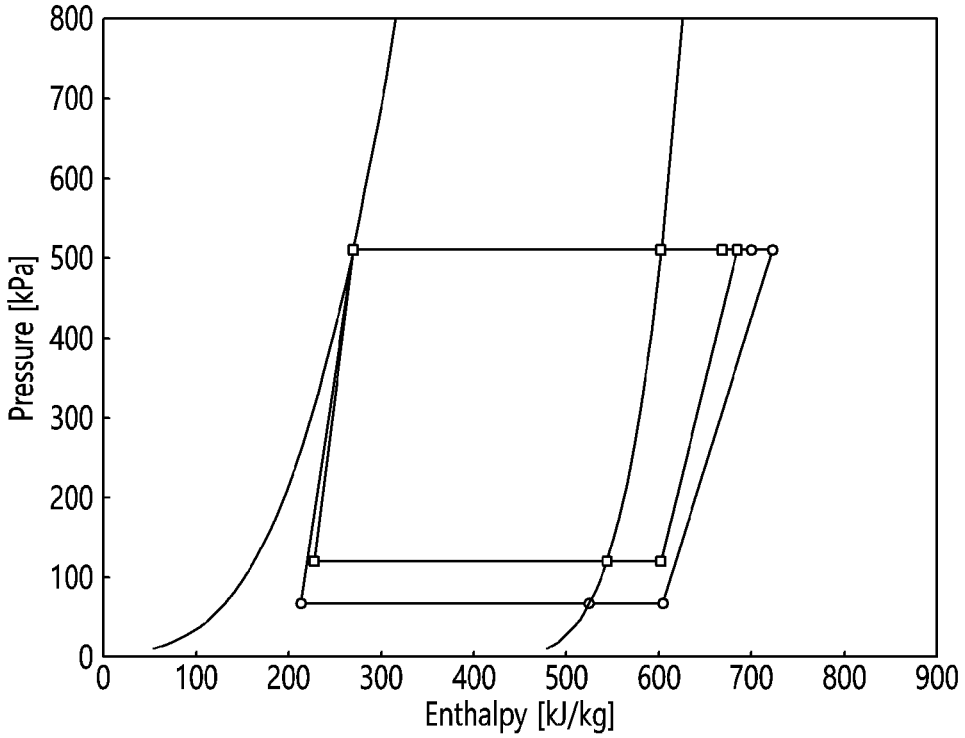

【Figure 4】
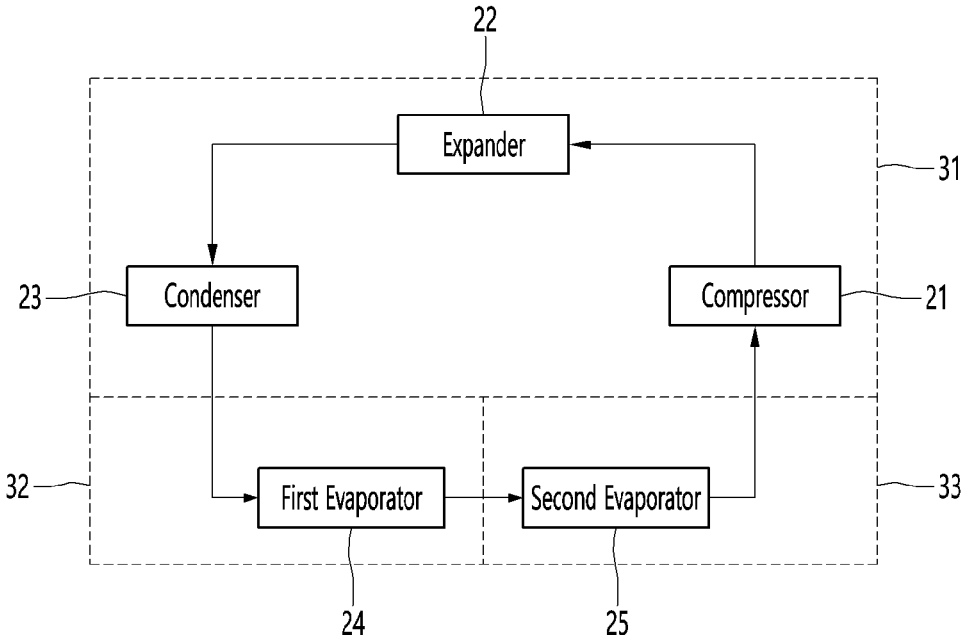

【Figure 5】
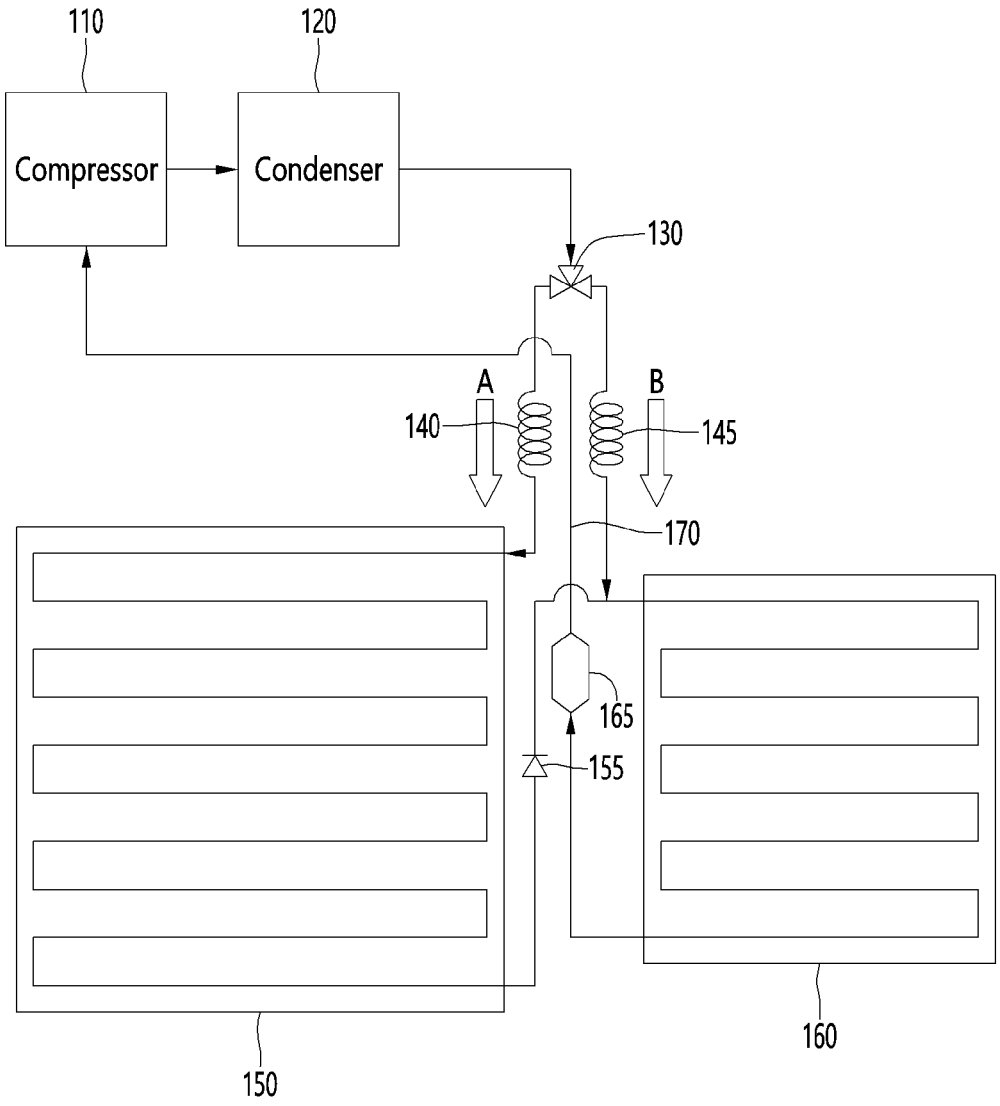

【Figure 6】
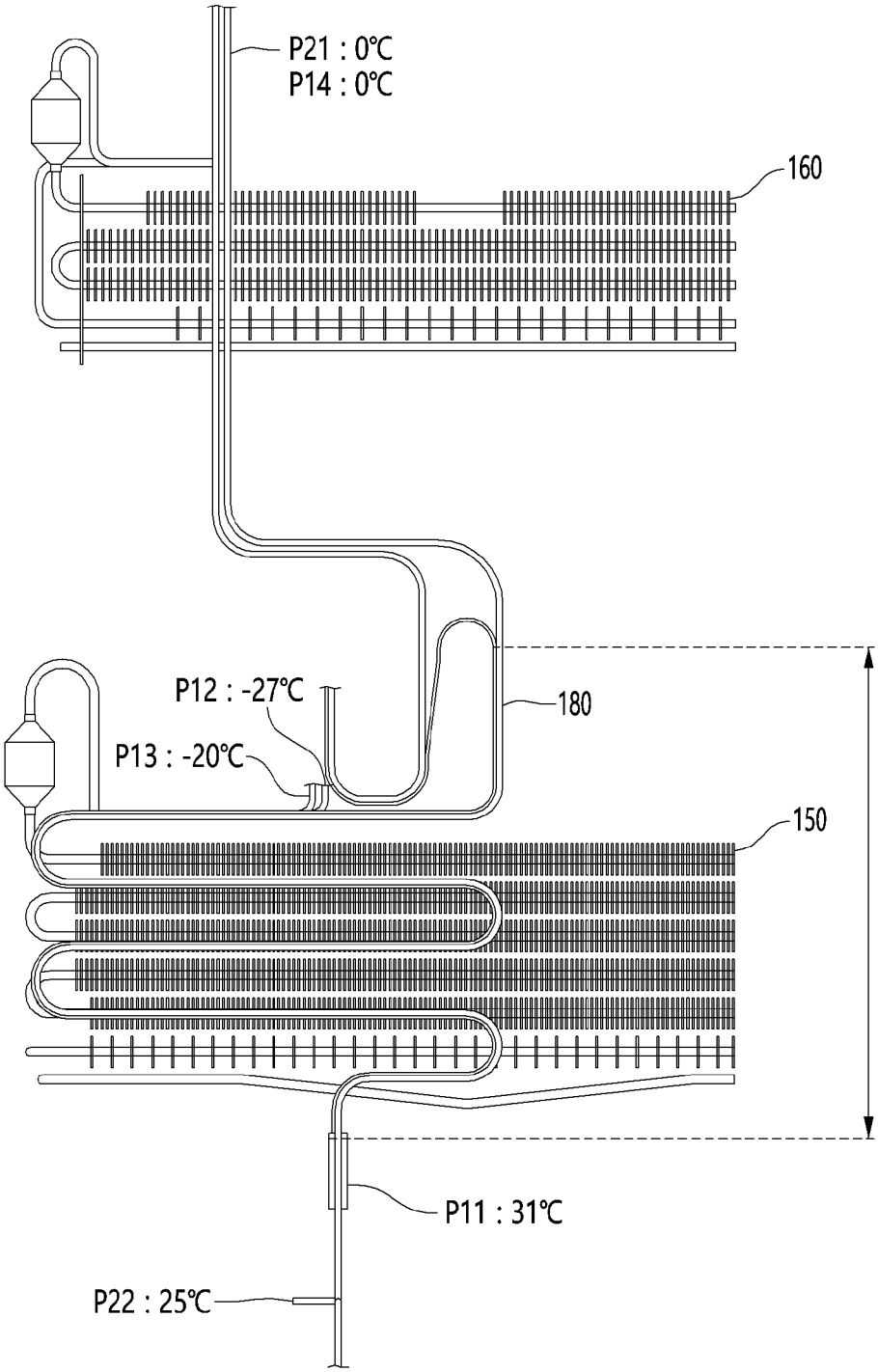

【Figure 7】
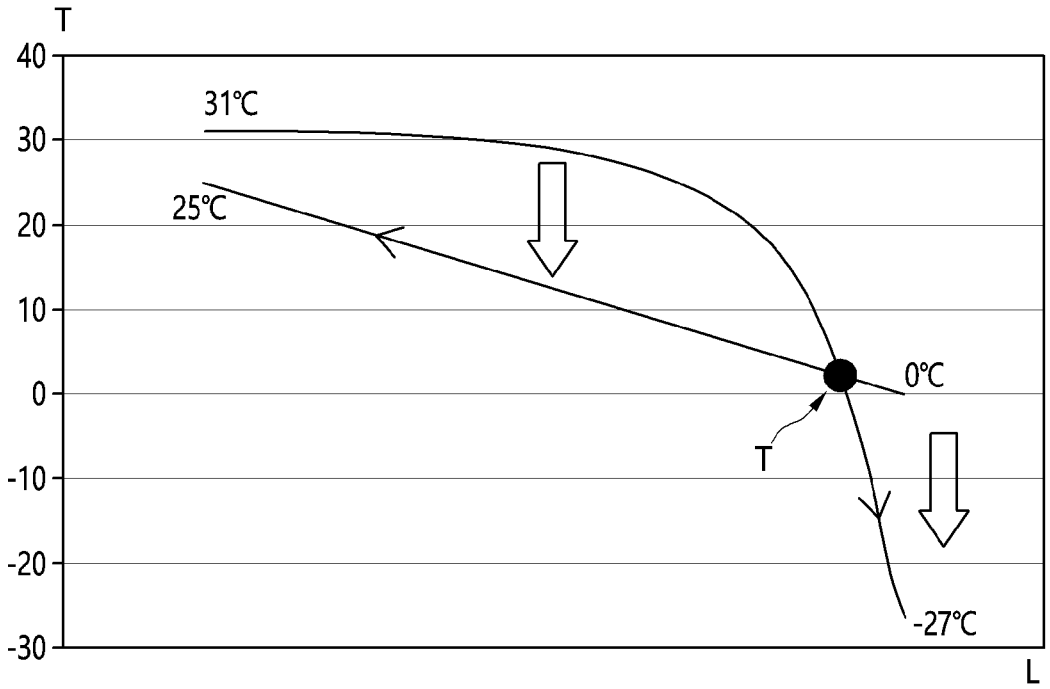

【Figure 8】
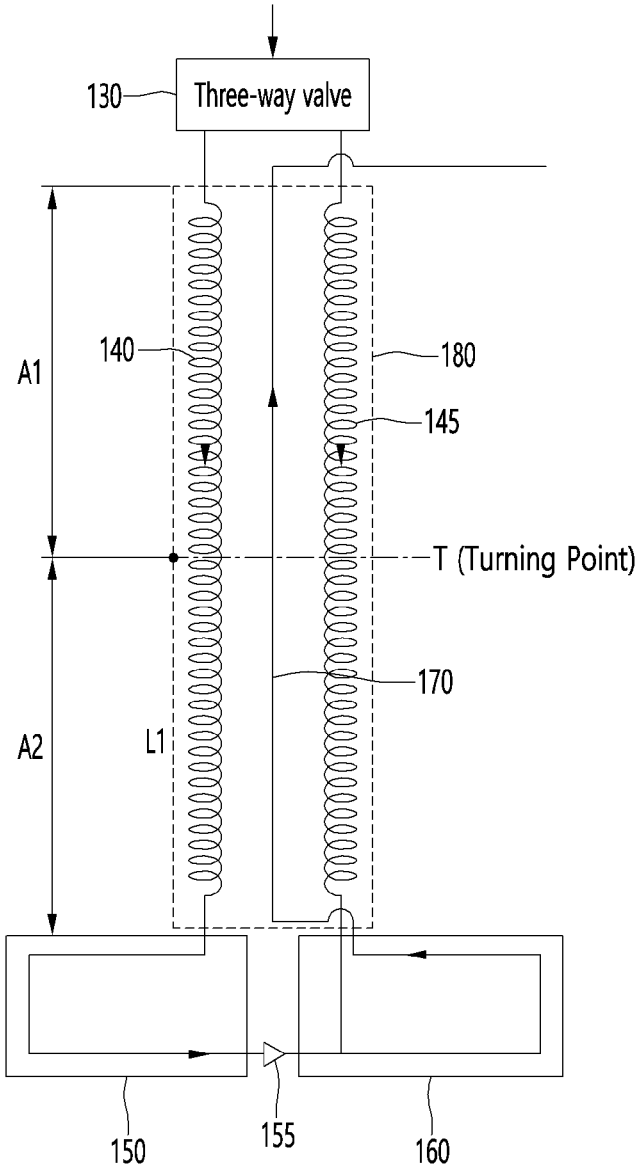

【Figure 9】
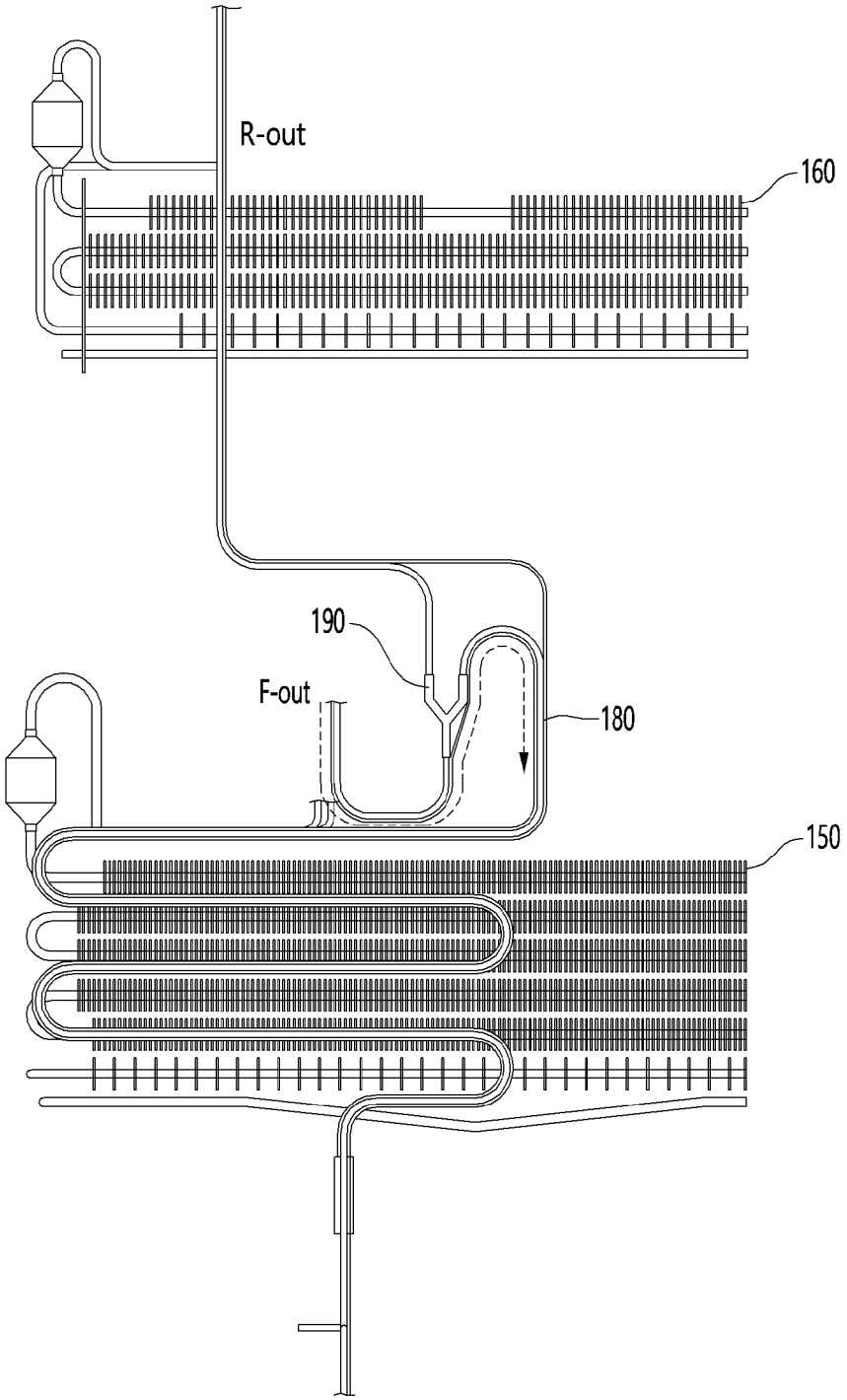

【Figure 10A】
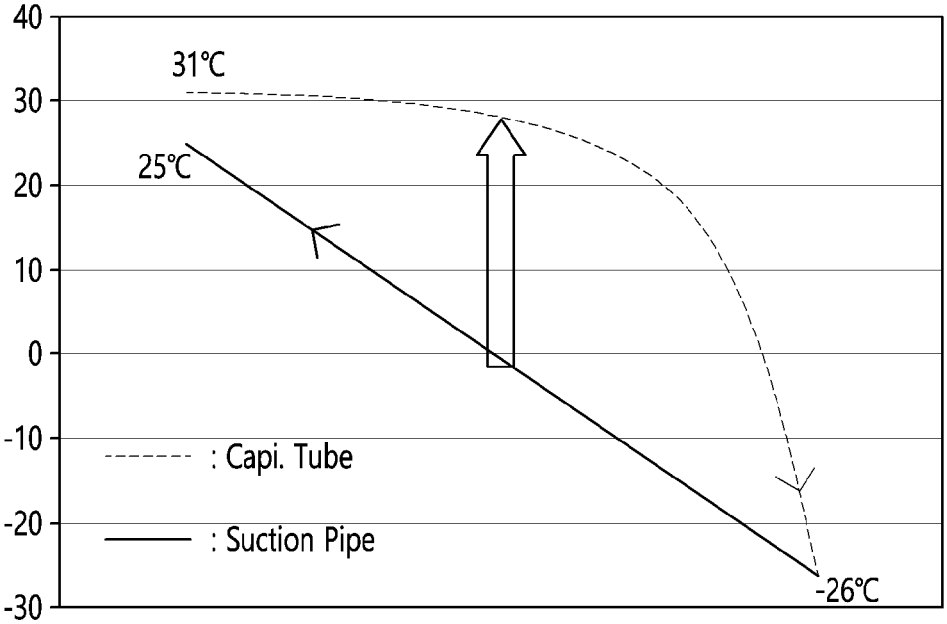
【Figure 10B】
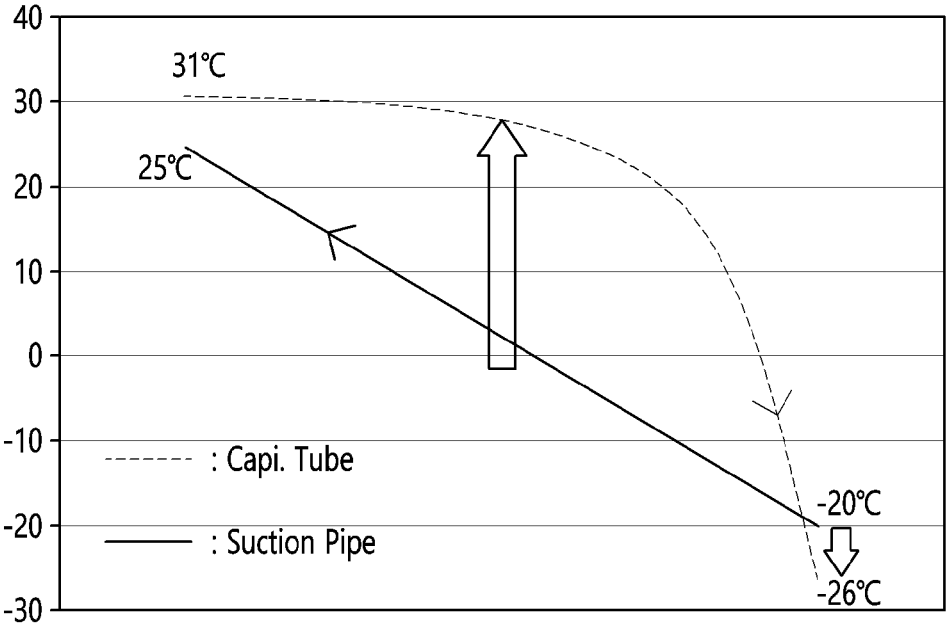

REFRIGERATING SYSTEM USING NON-AZEOTROPIC MIXED REFRIGERANT

CROSS-REFERENCE TO RELATED APPLICATIONS

This application is a National Stage filing under 35 U.S.C. 371 of International Application No. PCT/KR2020/011140, with an international filing date of Aug. 20, 2020, which claims the benefit of KR Patent Application No. 10-2019-0102341, filed on Aug. 21, 2019, all of which are incorporated by reference in their entirety herein.

TECHNICAL FIELD

A refrigerating system using a non-azeotropic mixed refrigerant is disclosed herein.

BACKGROUND ART

A refrigerating system is a system that provides cold air. In the refrigerating system, a refrigerant circulates through compression, condensation, expansion, and evaporation processes.

There are various types of refrigerants. A mixed refrigerant is a refrigerant in which two or more types of refrigerants are mixed. Mixed refrigerants include azeotropic mixed refrigerant and non-azeotropic mixed refrigerant.

The azeotropic mixed refrigerant is a refrigerant that changes phase without changing a composition of a gas phase and a liquid phase, similar to a single refrigerant. An evaporation temperature of the azeotropic mixed refrigerant is constant between an inlet and an outlet of the evaporator.

In the non-azeotropic mixed refrigerant, a refrigerant having a low boiling point evaporates first, and a refrigerant having a high boiling point evaporates later. Therefore, the non-azeotropic mixed refrigerant has different gas phase and liquid phase compositions during evaporation, and the evaporation temperature is low at the inlet of the evaporator and high at the outlet of the evaporator.

The non-azeotropic mixed refrigerant has a gliding temperature difference (GTD), which is a characteristic in which the temperature changes at equal pressure during phase change. Therefore, an evaporation operation of the non-azeotropic mixed refrigerant is divided into two evaporators. The first evaporator may be used for a freezer compartment, and the second evaporator through which the refrigerant having passed through the first evaporator may be used for a refrigerating compartment. The freezer compartment maintains a lower temperature than the refrigerating compartment. A multi-stage evaporator may be provided to increase a performance coefficient of the refrigerating system.

Documents that discloses such a refrigerating system are Korean Patent No. 2011-0115911 (hereinafter "Prior Art Document 1") entitled "Refrigerating apparatus using non-azeotropic mixed refrigerant and control method thereof" and U.S. Patent Publication No. 2015/0096325 (hereinafter "Prior Art Document 2") entitled "Refrigerators with a non-azeotropic mixtures of hydrocarbons refrigerants", which are both hereby incorporated by reference. Prior Art Document 1 discloses a refrigerating apparatus including one compressor, two evaporators connected in series to the compressor, and a three-way valve located between the two evaporators to bypass a refrigerant introduced into a downstream refrigerating compartment evaporator.

According to Prior Art Document 1, the refrigerant that has passed through an upstream freezer compartment evaporator is introduced into the three-way valve. As the refrigerant discharged from the freezer compartment evaporator is at an extremely low temperature reaching −20° C., there are problems, such as loss of cold air through the three-way valve located at an outside and the occurrence of frost on the outer surface of the three-way valve. In addition, an operation of cooling the refrigerating compartment alone may be impossible in terms of the position of the three-way valve.

Prior Art Document 2 discloses a refrigerating apparatus including one compressor, two evaporators connected in series to the compressor, and two heat exchangers in which refrigerant discharged from the two evaporators exchange heat with capillary tubes that expand the refrigerant. According to Prior Art Document 2, the operation of the freezer compartment or the refrigerating compartment alone is impossible. That is, only simultaneous operation of cooling the freezer compartment and the refrigerating compartment is possible. In addition, the refrigerating compartment evaporator into which the refrigerant discharged from the freezer compartment evaporator is introduced may be overcooled.

DISCLOSURE

Technical Problem

Embodiments disclosed herein provide a refrigerating system using a non-azeotropic mixed refrigerant, capable of implementing various operation modes. Embodiments disclosed herein provide a refrigeration system using a non-azeotropic mixed refrigerant, capable of further increasing a performance coefficient of the refrigerating system when the non-azeotropic mixed refrigerant is used. Embodiments disclosed herein provide a refrigerating system using a non-azeotropic mixed refrigerant to stably maintain a state of a refrigerant.

Technical Solution

According to embodiments disclosed herein, a refrigerating system may include a capillary tube configured to expand a non-azeotropic mixed refrigerant branched by a three-way valve and supply the expanded non-azeotropic mixed refrigerant to at least one of a first evaporator or a second evaporator. As the refrigerant may be supplied to any one of evaporators downstream of a three-way valve, the refrigerating system may be stably operated in various modes.

As a refrigerant outlet side of the first evaporator is connected to a refrigerant inlet side of the second evaporator by a connection pipe, the first evaporator and the second evaporator may supply cold air of an optimal state using a gliding temperature difference of the non-azeotropic mixed refrigerant supplied to the first evaporator. Further, as the connection pipe is provided with a check valve configured to allow the refrigerant to flow from the first evaporator to the second evaporator, reverse flow of the refrigerant may be prevented when an operation mode is switched.

The refrigerating system may include a compressor suction pipe configured to connect an outlet side of the second evaporator to an inlet side of the compressor, such that a circulating process of the non-azeotropic mixed refrigerant may be stably performed. A gas-liquid separator may be located in the compressor suction pipe, and only gas of evaporated refrigerant may be stably circulated toward the compressor. The capillary tube may include a first capillary tube configured to connect the three-way valve to a refrigerant inlet side of the first evaporator and a second capillary tube configured to connect the three-way valve to the refrigerant inlet side of the first evaporator, such that each refrigerant amount corresponding to a refrigeration capacity may be expanded.

The refrigerating system may include a regenerative heat exchanger in which at least one of at least a part or portion of the first capillary tube and at least a part or portion of the second capillary tube comes into contact with at least a part or portion of the compressor suction pipe to exchange heat with each other, thereby increasing efficiency of the refrigerating system. The regenerative heat exchanger may include a heat exchange region in which at least one of the at least the part or portion of the first capillary tube and the at least the part or portion of the second capillary tube exchanges heat with at least the part or portion of the compressor suction pipe, and a shielding region in which at least one of the at least the part or portion of the first capillary tube and the at least the part or portion of the second capillary tube is shielded not to exchange heat with the at least the part or portion of the compressor suction pipe. Therefore, optimal regenerative heat exchange may be performed according to a gliding temperature difference of the non-azeotropic mixed refrigerant, and thus, efficiency of the refrigerating system may be increased.

The shielding area may be a distance from a point (point T) to the evaporator, the point (point T) being a point at which a temperature of the non-azeotropic mixed refrigerant flowing through the capillary tube is lower than a temperature of the non-azeotropic mixed refrigerant flowing through the compressor suction pipe. Temperature reversal may be prevented to increase the heat exchange efficiency of the evaporator. As the temperature at the point T is within a range of −5° C. to 5° C., it is possible to check the heat exchange reversal point of the non-azeotropic mixed refrigerant and prevent the temperature reversal using the checked heat exchange reversal point.

As the shielding region is included within about 1 m or less from an outlet of the capillary tube and an inlet of the compressor suction pipe, regenerative heat exchange may be promoted and reduction of heat exchange efficiency due to temperature reversal may be prevented. As the non-azeotropic mixed refrigerant includes isobutane and propane, energy consumption efficiency of the refrigerating system may be improved.

According to another embodiment disclosed herein, a refrigerating system may include a compressor configured to compress a non-azeotropic mixed refrigerant, a condenser configured to condense the compressed non-azeotropic mixed refrigerant, an expander configured to expand the condensed non-azeotropic mixed refrigerant, an evaporator configured to evaporate the expanded non-azeotropic mixed refrigerant to supply cold air, and discharge the non-azeotropic mixed refrigerant to the compressor, and a regenerative heat exchanger configured to exchange heat between the non-azeotropic mixed refrigerant discharged from the evaporator and the non-azeotropic mixed refrigerant flowing through the expander, thereby improving heat efficiency of the refrigerating system. The regenerative heat exchanger may include a heat exchange region in which the evaporator and the expander contact each other and the non-azeotropic mixed refrigerant flowing through an inside of the evaporator exchanges heat with the non-azeotropic mixed refrigerant flowing through an inside of the expander, and a shielding region in which the evaporator and the expander are shielded from each other and the non-azeotropic mixed refrigerant flowing through the inside of the evaporator does not exchange heat with the non-azeotropic mixed refrigerant flowing through the inside of the expander. In this manner, heat exchange between the non-azeotropic mixed refrigerant may be controlled to improve heat efficiency of the refrigerating system.

According to another embodiment disclosed herein, a refrigerating system may include a compressor configured to compress a non-azeotropic mixed refrigerant, a condenser configured to condense the compressed non-azeotropic mixed refrigerant, an expander configured to expand the condensed non-azeotropic mixed refrigerant, at least two evaporators configured in series to evaporate the expanded non-azeotropic mixed refrigerant to supply cold air, and a three-way valve configured to branch the refrigerant condensed by the condenser to at least two branches and supply the branched refrigerant to the expander. Therefore, as the non-azeotropic mixed refrigerant flows through an optimal passage according to an operation mode of the refrigerating system, it is possible to appropriately cope with the operation mode. The three-way valve may perform a mode in which the non-azeotropic mixed refrigerant is supplied to an upstream evaporator of the at least two evaporators, such that the at least two evaporators supply cold air. Therefore, a flow rate of the refrigerant circulating through the refrigerating system is controlled such that a large amount of refrigerant flows, thereby operating the refrigerating system in response to the freezing/refrigerating mode.

The upstream evaporator of the at least two evaporators supplies cold air of a temperature lower than a downstream evaporator of the at least two evaporators. Therefore, irreversible loss during heat exchange may be reduced to obtain higher operating efficiency of the refrigerating system.

The downstream evaporator of the at least two evaporators may not supply cold air, and only the upstream evaporator may supply cold air. In this case, the refrigerant may flow through the downstream evaporator, but may not be used for supply of cold air.

The three-way valve may be operated such that only one of the at least two evaporators supplies cold air. Therefore, it may be operated in a freezing mode, a refrigerating mode, or a freezing/refrigerating mode.

The three-way valve may perform only a freezing mode by directly supplying the non-azeotropic mixed refrigerant to the downstream evaporator. The expander may be placed on a refrigerant inlet side of each of the at least two evaporators. The non-azeotropic mixed refrigerant may be expanded in response to each mode of the refrigerating system.

Advantageous Effects

According to embodiments disclosed herein, it is possible to satisfy various operation modes required in a refrigerating apparatus, such as simultaneous operation of a freezer compartment and a refrigerating compartment and operation of the refrigerating compartment alone.

According to embodiments disclosed herein, a coefficient of performance may be improved by arranging a multi-stage evaporator, and the coefficient of performance may be further improved using flow of a non-azeotropic mixed refrigerant. According to embodiments disclosed herein, in response to a phase change of the refrigerant generated when the multi-stage evaporator is arranged, a state of refrigerant may be stably formed in a liquid phase and a gas phase in accordance with specifications required by the refrigerating system.

DESCRIPTION OF DRAWINGS

FIG. 1 is a schematic temperature graph of a non-azeotropic mixed refrigerant and air in a counterflow evaporator;

FIG. 2 is a graph showing a temperature difference between an inlet and an outlet of an evaporator and a gliding temperature difference of a non-azeotropic mixed refrigerant according to compositions of isobutane and propane;

FIG. 3A is a graph showing a refrigeration cycle when isobutane is used as a refrigerant;

FIG. 3B is a graph showing a refrigeration cycle when a non-azeotropic mixed refrigerant is used as a refrigerant; and FIG. 4 is a view showing a refrigerating apparatus according to an embodiment;

FIG. 5 is a schematic view of a refrigerating system applicable to a refrigerating apparatus according to an embodiment;

FIG. 6 is a schematic view of an evaporator and capillary tubes;

FIG. 7 is a schematic showing temperature change in a refrigerant pipe and compressor suction pipe in a regenerative heat exchanger;

FIG. 8 is a partial view of the refrigerating system, in which a regenerative heat exchanger is exaggerated;

FIG. 9 is a schematic view of an evaporator and capillary tubes in a parallel 1-compression 2-evaporation system; and FIGS. 10A-10B are temperature graphs explaining heat exchange reversal region in a parallel 1-compression 2-evaporation system.

BEST MODE

Hereinafter, embodiments will be described with reference to the accompanying drawings. The embodiments are not limited to the embodiments discussed hereinafter, and those skilled in the art who understand the spirit will be able to easily propose other embodiments falling within the scope by adding, modifying, and deleting components. However, this also falls within the spirit.

First, a non-azeotropic mixed refrigerant that is preferably applicable is presented. In the description related to the selection of the non-azeotropic mixed refrigerant, contents of the present disclosure are divided into technical elements and described in detail. First, a process of selecting a type of a non-azeotropic mixed refrigerant will be described.

Selection of Type of Non-Azeotropic Mixed Refrigerant

Refrigerants to be mixed, which are suitable for the non-azeotropic mixed refrigerant, are proposed. As the refrigerant to be mixed, a hydrocarbon-based (HC-based) refrigerant may be selected. Hydrocarbon-based refrigerant is an eco-friendly refrigerant having a low ozone depletion potential (ODP) and a low global warming potential (GWP). The criteria for selecting a refrigerant suitable for the non-azeotropic mixed refrigerant among hydrocarbon-based refrigerants may be summarized as follows.

First, from a viewpoint of compression work, when a difference (pressure difference (ΔP)) between a condensing pressure (Pd or p1) and an evaporation pressure (Ps or p2) is smaller, compression work of the compressor is further reduced, which is advantageous for efficiency. Therefore, refrigerants having a low condensing pressure and a high evaporation pressure may be selected. However, considering reliability of compressors, an evaporation pressure of 50 kPa or more may be selected.

Second, from a viewpoint of utilization of production facilities, refrigerants may be selected which have been used in the past for compatibility of existing facilities and components. Third, from a viewpoint of purchase costs of refrigerants, refrigerants obtainable at low cost may be selected. Fourth, from a viewpoint of safety, refrigerants that are not harmful to humans when refrigerant leaks may be selected.

Fifth, from a viewpoint of reducing irreversible loss, reduction of a temperature difference between a refrigerant and cold air so as to increase efficiency of a cycle is desirable. Sixth, from a viewpoint of handling, refrigerants that can be conveniently handled at a time of work and may be conveniently injected by handlers may be selected.

The above criteria for selecting refrigerants is variously applied in selecting the non-azeotropic mixed refrigerant.

Classification and Selection of Hydrocarbons

Based on evaporation temperature (Tv), candidate refrigerants suggested by the National Institute of Standards and Technology are classified into three (upper, middle, and lower) groups in descending order of evaporation temperature. A density of refrigerant is higher as evaporation temperature increases.

A combination of candidate refrigerants capable of exhibiting an evaporation temperature of −20° C. to −30° C. suitable for the environment of refrigerating apparatuses may be selected. Hereinafter, classification of the candidate refrigerants will be described.

The candidate refrigerants are classified into three types based on boundary values of evaporation temperature, that is, −12° C. and −50° C. The candidate refrigerants classified into the three types are shown in Table 1. It can be seen that the classification of the evaporation temperature changes greatly based on the boundary values.

TABLE 1

| No. | group | Hydro-carbon name | Evaporation temperature (1 bar) | Evaporation temperature (20 bar) ° C. | Triple point temperature |
|---|---|---|---|---|---|
| 1 | upper | isopentane | 27.5 | 154.7 | −159.85 |
| 2 | | 1,2-butadiene | 10.3 | 124.8 | −136.25 |
| 3 | | n-butane | −0.9 | 114.5 | −138.25 |
| 4 | | butene | −6.6 | 105.8 | −185.35 |
| 5 | | isobutane | −12 | 100.7 | −159.65 |
| 6 | middle | propadiene | −34.7 | 68.2 | −136.25 |
| 7 | | propane | −42.4 | 57.3 | −187.71 |
| 8 | | propylene | −47.9 | 48.6 | −185.26 |
| 9 | lower | ethane | −88.8 | −7.2 | −182.80 |
| 10 | | ethylene | −104 | −29.1 | −169.15 |

Referring to Table 1, refrigerants that may be mixed as the non-azeotropic mixed refrigerant may be selected and combined in each region. First, which group is selected among the three groups will be described. There may be one case in which refrigerants are selected from the three groups and three refrigerants are mixed, and three cases in which refrigerants are selected from two groups and two refrigerants are mixed.

When at least one refrigerant is selected from each of the three groups and three or more refrigerants are mixed, the temperature rise and drop in the non-azeotropic mixed refrigerant may be excessively great. In this case, design of the refrigerating system may be difficult.

Thus, the non-azeotropic mixed refrigerant may be obtained by selecting at least one refrigerant from each of two groups. At least one refrigerant may be selected from each of the middle group and the lower group, from each of the upper group and the middle group, and from each of the upper group and the lower group. Among them, a composition in which at least one refrigerant selected from each of the upper group and the middle group is mixed may be provided as the non-azeotropic mixed refrigerant.

When at least one refrigerant selected from each of the middle group and the lower group is mixed, the evaporation temperature of the refrigerant is excessively low. Thus, a difference between interior temperature and the evaporation temperature of the refrigerant is excessively great in a general refrigerating apparatus. Therefore, efficiency of the refrigeration cycle deteriorates and power consumption increases.

When at least one refrigerant selected from each of the upper group and the lower group is mixed, a difference in evaporation temperature between the at least two refrigerants is excessively great. Therefore, unless a special high-pressure environment is created, each refrigerant is classified into a liquid refrigerant and a gaseous refrigerant under actual use conditions. For this reason, it is difficult to inject the at least two refrigerants together into a refrigerant pipe.

Selection of Hydrocarbons in Groups of Hydrocarbons

Which refrigerant is selected from the upper group and the middle group will be described hereinafter.

First, the refrigerant selected from the upper group will be described. At least one refrigerant selected from the upper group may be used as the non-azeotropic mixed refrigerant.

As isopentane and butadiene have a relatively high evaporation temperature, the inner temperature of the evaporator of the refrigerating apparatus is limited and freezing efficiency deteriorates. Isobutane and N-butane may be used without changing components of the refrigeration cycle, such as the compressor of the refrigerating apparatus, currently used. Therefore, their use is most expected among the refrigerants included in the upper group.

N-butane has a smaller compression work than isobutane, but has a low evaporation pressure (Ps), which may cause a problem in the reliability of the compressor. For this reason, isobutane may be selected from the upper group. As described above, selection of at least one from the other hydrocarbons included in the upper group is permissible.

The refrigerant selected from the middle group will be described hereinafter. At least one refrigerant selected from the middle group may be used in the non-azeotropic mixed refrigerant.

As propadiene has a smaller pressure difference (ΔP) than that of propane, efficiency is high. However, propadiene is expensive and harmful to respiratory systems and skin when humans inhale due to leakage. Propylene has a greater pressure difference than that of propane, and thus, compression work of the compressor is increased.

For this reason, propane may be selected from the middle group. As described above, selection of at least one from the other hydrocarbons included in the middle group is permissible.

For reference, isobutane may also be referred to as R600a, and propane may also be referred to as R290. Although isobutane and propane may be selected, other hydrocarbons belonging to the same group may be applied in obtaining properties of the non-azeotropic mixed refrigerant, even where there is no specific mention in the following description. For example, if it is possible to obtain a similar gliding temperature difference of the non-azeotropic mixed refrigerant, other compositions than isobutane and propane may be used.

Selection of Ratio of Selected Hydrocarbon Refrigerant, Considering Power Consumption of Compression Work As the refrigerant to be mixed in the non-azeotropic mixed refrigerant, isobutane is selected from the upper group and propane is selected from the middle group. Ratios of the refrigerants to be mixed in the non-azeotropic mixed refrigerant may be selected as follows.

Power consumption of the compressor, which is a main energy consumption source of the refrigerating system, depends on the pressure difference. In other words, as the pressure difference is increases, more compression work needs to be consumed. As the compression work increases, efficiency of the cycle further deteriorates.

Isobutane has a smaller pressure difference (ΔP) than that of propane. For this reason, the non-azeotropic mixed refrigerant may be provided with a weight ratio of isobutane of 50% or more and a weight ratio of propane of 50% or less.

In the case of a composition in which the non-azeotropic mixed refrigerant includes isobutane and propane mixed at a ratio of 5:5, the condensing pressure is 745.3 kPa, the evaporation pressure is 120.5 kPa, and the pressure difference is 624.7 kPa. In the case of a composition in which the non-azeotropic mixed refrigerant is substantially isobutane with a very small amount of propane, the condensing pressure is 393.4 kPa, the evaporation pressure is 53.5 kPa, and the pressure difference is 340.0 Pa.

The pressure is obtained by measuring an average value when the compressor is turned on under ISO power consumption measurement conditions. All values related to the composition of the non-azeotropic mixed refrigerant are obtained under the same conditions.

Ranges of the condensing pressure, the evaporation pressure, and the pressure difference of the non-azeotropic mixed refrigerant may be known using a mixing ratio of isobutane to propane that can reduce the compression work as described above.

Selection of Ratio of Selected Hydrocarbon Refrigerant, Considering Irreversible Loss of Evaporator As described above, the non-azeotropic mixed refrigerant has a gliding temperature difference (GTD) upon phase change. Using the gliding temperature difference, evaporators may be sequentially installed in a freezer compartment and a refrigerating compartment to provide an appropriate temperature atmosphere for each partitioned space. According to the gliding temperature difference, a temperature difference between air and refrigerant evaporated in each evaporator may be reduced, thereby reducing irreversibility occurring during heat exchange. Reduction in irreversible loss may reduce the loss of the refrigerating system.

FIG. 1 is a schematic temperature graph of a non-azeotropic mixed refrigerant and air in a counterflow evaporator. In FIG. 1, the horizontal axis represents progress distance, and the air and the non-azeotropic mixed refrigerant move in opposite directions as indicated by arrows. In FIG. 1, the vertical axis represents temperature. Referring to FIG. 1, 1 is a line for air, 2 is a line for the non-azeotropic mixed refrigerant, 3 is a line for temperature rise of the non-azeotropic mixed refrigerant, 4 is a line for temperature drop of the non-azeotropic mixed refrigerant, and 5 is a line for a single refrigerant.

Referring to the line 1 for air, for example, the temperature of the air may drop from a range of −20° C. to −18° C. and the air may pass through the evaporator. Referring to the line 2 for the non-azeotropic mixed refrigerant, the temperature of the non-azeotropic mixed refrigerant may rise from −27° C. and the non-azeotropic mixed refrigerant may pass through the evaporator. The gliding temperature difference of the non-azeotropic mixed refrigerant may change according to the ratio of isobutane to propane. When the gliding temperature difference is increased, the line 2 for the non-azeotropic mixed refrigerant may move toward the line 3 for the temperature rise of the non-azeotropic mixed refrigerant. When the gliding temperature difference is decreased, the line 2 for the non-azeotropic mixed refrigerant may move toward the line 4 for the temperature drop of the non-azeotropic mixed refrigerant. For reference, as there is no phase change in the single refrigerant, there is no temperature change in the line 5 for the single refrigerant.

Irreversible loss when heat exchange occurs cannot be avoided due to the temperature difference between two interfaces where heat exchange occurs. For example, when there is no temperature difference between interfaces of two objects that exchange heat with each other, there is no irreversible loss, but heat exchange does not occur.

However, there are various methods for reducing irreversible loss due to heat exchange. A representative method is to configure a heat exchanger with counterflow. A counterflow heat exchanger may reduce irreversible loss by allowing the temperature difference between moving fluids to be reduced as much as possible.

In the case of an evaporator to which the non-azeotropic mixed refrigerant is applied, the heat exchanger may be configured with counterflow as shown in FIG. 1. As the temperature of the non-azeotropic mixed refrigerant is increased during evaporation due to the gliding temperature difference, the temperature difference between the air and the non-azeotropic mixed refrigerant may be reduced. When the gliding temperature difference of the non-azeotropic mixed refrigerant and the temperature difference of the air are reduced, irreversible loss may be reduced and efficiency of the refrigeration cycle may be increased.

The gliding temperature difference of the non-azeotropic mixed refrigerant may not be increased infinitely due to limitations of the refrigerant. In addition, when the gliding temperature difference of the non-azeotropic mixed refrigerant is changed, the gliding temperature difference of the cold air is changed. Accordingly, a size of the evaporator is changed and total efficiency of the refrigeration cycle is affected. For example, when the gliding temperature difference is increased, the inlet temperature of the refrigerant is decreased or the outlet temperature of the refrigerant is overheated, thus reducing efficiency of the refrigeration cycle.

On the other hand, the gliding temperature difference of the non-azeotropic mixed refrigerant and the temperature difference of the air may converge to zero if a size of the heat exchanger is infinitely large. However, considering mass productivity and cost reduction of the heat exchanger, in the case of a general refrigerating apparatus, the gliding temperature difference of the non-azeotropic mixed refrigerant and the temperature difference of the air are about 3° C. to 4° C.

FIG. 2 is a graph showing a temperature difference between an inlet and an outlet of an evaporator and a gliding temperature difference of a non-azeotropic mixed refrigerant according to compositions of isobutane and propane. The horizontal axis represents a content of isobutane, and the vertical axis represents a temperature difference.

Referring to FIG. 2, when isobutane and propane are each included in 100%, there is no temperature change while isobutane and propane undergo evaporation as a single refrigerant. When isobutane and propane are mixed, there are the gliding temperature difference of the non-azeotropic mixed refrigerant and the temperature difference between the inlet and the outlet of the evaporator. A temperature difference 11 between the inlet and the outlet of the evaporator is smaller than a gliding temperature difference 12 of the non-azeotropic mixed refrigerant. This may be caused by incomplete heat transfer between the refrigerant and air.

When the gliding temperature difference of the non-azeotropic mixed refrigerant is greater than the temperature difference between the inlet and the outlet of the evaporator, characteristics of the non-azeotropic mixed refrigerant may be well utilized. Also, it is advantageous from a viewpoint of reducing irreversibility in heat exchange and increasing efficiency of the refrigeration cycle. Likewise, the gliding temperature difference of the non-azeotropic mixed refrigerant may be greater than the temperature difference of the air passing through the evaporator.

In a general refrigerating apparatus, the temperature difference of the air passing through the inlet and the outlet of the evaporator may reach 4° C. to 10° C. In most cases, the temperature difference of air is close to 4° C. For this reason, the gliding temperature difference of the non-azeotropic mixed refrigerant may be maintained higher than 4° C. Maintaining the gliding temperature difference to be at least 4.1° C. or higher, which is minimally higher than the temperature difference between the inlet and the outlet of the evaporator, may be advantageous. When the gliding temperature difference of the non-azeotropic mixed refrigerant is less than 4.1° C., thermal efficiency of the refrigeration cycle may decrease.

In contrast, when the gliding temperature difference of the non-azeotropic mixed refrigerant is greater than 4.1° C., the temperature difference between the air and the refrigerant at the outlet side of the refrigerant decreases, irreversibility decreases, and thermal efficiency of the refrigeration cycle increases. That the temperature difference between the air and the refrigerant at the outlet side of the refrigerant decreases means that the line 2 for the non-azeotropic mixed refrigerant moves toward the line 3 for the temperature rise of the non-azeotropic mixed refrigerant in FIG. 1.

In FIG. 2, when the gliding temperature difference of the non-azeotropic mixed refrigerant is 4.1° C., isobutane is 90%, and when the gliding temperature difference of the non-azeotropic mixed refrigerant is greater than 4.1° C., isobutane is less than 90%. In order to minimize compression work of the compressor, isobutane may be 50% or more.

As a result, a weight ratio of the non-azeotropic mixed refrigerant provided as isobutane and propane may be expressed as in Equation 1.

$$50\% \leq \text{isobutane} \leq 90\% \quad \text{[Math FIG. 1]}$$

Propane is the remaining or other component in the weight ratio of the non-azeotropic mixed refrigerant.

As the gliding temperature difference of the non-azeotropic mixed refrigerant increases, irreversible loss may be reduced. However, when the gliding temperature difference is excessively great, a size of the evaporator becomes excessively large in order to secure a sufficient heat exchange passage between the refrigerant and the air. A space inside of the refrigerating apparatus may be secured when the evaporator applied to a general household refrigerating apparatus is designed with a capacity of 200 W or less. For this reason, the gliding temperature difference of the non-azeotropic mixed refrigerant may be limited to 7.2° C. or less.

In addition, when the gliding temperature difference of the non-azeotropic mixed refrigerant is excessively great, the temperature of the inlet of the evaporator may be too low or the outlet of the evaporator outlet may be overheated too quickly, based on the non-azeotropic mixed refrigerant. An available area of the evaporator may be reduced and efficiency of the heat exchange may decrease.

At the outlet of the evaporator, the temperature of the non-azeotropic mixed refrigerant has to be higher than the temperature of the air introduced into the evaporator. Otherwise, efficiency of the heat exchanger decreases due to reversal of the temperatures of the refrigerant and air. When this condition is not satisfied, efficiency of the refrigerating system may be reduced.

In FIG. 2, when the gliding temperature difference of the non-azeotropic mixed refrigerant is 7.2° C., isobutane is 75%, and when the gliding temperature difference of the non-azeotropic mixed refrigerant is less than 7.2° C., isobutane is more than 75%. As a result, considering this condition and the condition of Equation 1 together, a weight ratio of the non-azeotropic mixed refrigerant provided as isobutane and propane may be expressed as in Equation 2.

$$75\% \leq \text{isobutane} \leq 90\% \quad \text{[Math FIG. 2]}$$

Propane is the remaining or other component in the weight ratio of the non-azeotropic mixed refrigerant.

Selection of Ratio of Selected Hydrocarbon Refrigerant, Considering Compatibility of Production Facilities and Components The temperature difference between the inlet and the outlet of the evaporator of a general refrigerating apparatus may be set to 3° C. to 5° C. This is due to various factors, such components of the refrigerating apparatus, internal volume of the machine room, heat capacity of each component, and size of the fan, for example. When a composition ratio of the non-azeotropic mixed refrigerant capable of providing the temperature of the inlet and the outlet of the evaporator, that is, 3° C. to 5° C., is found in FIG. 2, it can be seen that isobutane is between 76% and 87%.

As a result of the above discussion, the non-azeotropic mixed refrigerant that satisfies all of the above-described conditions may be expressed as Equation 3.

$$76\% \leq \text{isobutane} \leq 87\% \quad \text{[Math FIG. 3]}$$

Propane is the remaining or other component in the weight ratio of the non-azeotropic mixed refrigerant.

Ratio of Hydrocarbon Refrigerant to be Finally Applied

The isobutane application range that can be selected on the basis of the various criteria described above may be determined to be 81% to 82%, which is the middle range of Equation 3. Propane may occupy the remaining portion or component of the non-azeotropic mixed refrigerant.

The case of using only isobutane was compared with the case of using the non-azeotropic mixed refrigerant in which 85% of isobutane and 15% of propane were applied. In both cases, the evaporators were constructed in parallel to form the cycle of the refrigerating system.

The experimental conditions were −29° C. and −15° C. and the inlet temperatures of the compressors were 25° C., respectively. Due to the difference in the refrigerant, the temperature of the condenser was 31° C. when using only isobutane and 29° C. when using the non-azeotropic mixed refrigerant.

FIGS. 3A and 3B are tables for comparison of the refrigeration cycle in each case. FIG. 3A is a graph showing the refrigeration cycle when only isobutane is used. FIG. 3B is a graph showing the refrigeration cycle when the non-azeotropic mixed refrigerant is used.

In the experiment according to FIGS. 3A-3B, it can be seen that when the non-azeotropic mixed refrigerant is used, improvement in coefficient of performance was approximately 4.5%.

FIG. 4 is a view showing a refrigerating apparatus according to an embodiment. Referring to FIG. 4, a refrigerating apparatus according to an embodiment may include a machine room 31, a freezer compartment 32, and a refrigerating compartment 33. The refrigerating apparatus forms a refrigeration cycle that uses the non-azeotropic mixed refrigerant. In the refrigeration cycle, a compressor 21 that compresses the refrigerant, an expander 22 that expands the compressed refrigerant, a condenser 23 that condenses the expanded refrigerant, and first and second evaporators 24 and 25 that evaporates the condensed refrigerant may be included.

The compressor 21, the expander 22, and the condenser 23 may be provided in the machine room 31. The first evaporator 24 may be provided in the freezer compartment 32. The second evaporator 25 may be provided in the refrigerating compartment 33. The freezer compartment and the refrigerating compartment may be referred to as an "interior space".

A temperature of the non-azeotropic mixed refrigerant may be lower in the first evaporator 24 than in the second evaporator 25. As the first evaporator 24 is placed in the freezer compartment 32, the refrigerating system may be operated more appropriately in a partitioned space of the refrigerating apparatus. Therefore, irreversible loss may be further reduced in the evaporation operation of the evaporator.

FIG. 5 is a schematic view of a refrigerating system applicable to a refrigerating apparatus according to an embodiment. Referring to FIG. 5, the refrigerating system according to this embodiment may include a compressor 110 that compresses a refrigerant, a condenser 120 that condenses the compressed refrigerant, and evaporators 150 and 160 that evaporate the refrigerant condensed by the condenser 120. The refrigerant evaporated by the evaporators 150 and 160 may circulate to the compressor 110.

The evaporators 150 and 160 may include first evaporator 150 capable of supplying cold air to a freezer compartment and second evaporator 160 capable of supplying cold air to a refrigerating compartment. A three-way valve 130 capable of branching and supplying the condensed refrigerant to the evaporators 150 and 160 may be further provided. The three-way valve 130 may selectively supply the refrigerant supplied from the condenser 120 to the first evaporator 150 or the second evaporator 160. The three-way valve 130 may be a multi-directional valve that branches introduced refrigerant to at least two places. As the three-way valve 130 branches the refrigerant in multiple directions, the three-way valve 130 may also be referred to as a "multi-directional valve".

The refrigerant heat-exchanged in the first evaporator 150 may be supplied to the second evaporator 160. The refrigerant may be a non-azeotropic mixed refrigerant and a temperature of the refrigerant may rise during evaporation. The first evaporator 150 may evaporate the refrigerant at a lower temperature than the second evaporator 160. Therefore, the first evaporator 150 may be more suitable for supplying cold air to the freezer compartment, and the second evaporator 160 may be more suitable for supplying cold air to the refrigerating compartment.

The first evaporator 150 and the second evaporator 160 may be connected in series based on a refrigerant flow. These advantages are remarkable as compared to a case of using a single refrigerant or an azeotropic mixed refrigerant.

Advantages of the non-azeotropic mixed refrigerant when two evaporators are used in a single compressor will be described hereinafter.

First, a refrigerating system using two evaporators in a single compressor (hereinafter, simply referred to as a "1-compression 2-evaporation system") may use a single refrigerant or an azeotropic mixed refrigerant, a temperature of which does not change during evaporation. The evaporators may include a refrigerating compartment evaporator that supplies cold air to the refrigerating compartment and a freezer compartment evaporator that supplies cold air to the freezer compartment.

In this case, when the two evaporators are connected in parallel, the refrigerant concentrates in the freezer compartment evaporator increasing irreversible loss and control is difficult. In contrast, when the two evaporators are connected in series, a thermal insulation load in the freezer compartment is large, and thus, refrigerant has to be supplied to the freezer compartment evaporator after passing through the refrigerating compartment evaporator. This is because the refrigerant has to remain in the freezer compartment evaporator for a long time in order to cope with the thermal insulation load of the freezer compartment.

The three-way valve may be installed upstream of the refrigerating compartment evaporator. According to the three-way valve, the refrigerant may be supplied to the freezer compartment evaporator without passing through the refrigerating compartment evaporator. In this manner, overcooling of the refrigerating compartment corresponding to the refrigerating compartment evaporator may be prevented. This may be referred to as a "serial bypass 1-compression 2-evaporation system".

The serial bypass 1-compression 2-evaporation system is difficult to accurately control because a flow rate control of refrigerant corresponding to the interior space and intermittent control of the three-way valve corresponding to change in thermal insulation loads of the refrigerating compartment and freezer compartment are continuously required. In addition, as refrigerant of different states passing through different passages are continuously mixed, irreversible loss increases and power consumption increases.

As a solution to this problem, a non-azeotropic mixed refrigerant may be used in a 1-compression 2-evaporation system. The temperature of the non-azeotropic mixed refrigerant rises during evaporation. Using this property, the refrigerant may be supplied to the refrigerating compartment evaporator after passing through the freezer compartment evaporator. In this case, while the non-azeotropic mixed refrigerant is evaporated, cold air may be supplied to the freezer compartment at a first temperature corresponding to a temperature of the freezer compartment, and cold air may be supplied to the refrigerating compartment at a second temperature corresponding to a temperature of the refrigerating compartment. The second temperature may be higher than the first temperature.

The gliding temperature difference of the non-azeotropic mixed refrigerant may be used such that the refrigerant flows into two evaporators in series. Therefore, irreversible loss caused by the mixing of refrigerants having different properties may be reduced. Therefore, power consumption may be reduced.

The refrigerating system according to this embodiment may be referred to as a "serial bypass 1-compression 2-evaporation" system in which the three-way valve 130 is located upstream of the first evaporator 150 and the second evaporator 160. Due to the three-way valve 130, the refrigerant may be supplied to both of the evaporators 150 and 160, or the refrigerant may bypass the first evaporator 150 and may be supplied to only the second evaporator 160. In other words, operation of the refrigerating compartment (flow B in FIG. 5) alone, and simultaneous operation of the refrigerating compartment and the freezer compartment (flow A in FIG. 5) are possible.

The operation of the freezer compartment alone reduces a frequency of the compressor with respect to simultaneous operation of the refrigerating compartment and the freezer compartment, thus lowering freezer capacity. Therefore, operation of the freezer compartment alone may be performed by evaporating all of the refrigerant in the first evaporator 150 corresponding to the freezer compartment. A fan of the refrigerating compartment may be turned off by another method or a combined method.

In all modes of operation of the refrigerating compartment alone, simultaneous operation of the refrigerating compartment and the freezer compartment, and operation of the freezer compartment alone, the temperature of the non-azeotropic mixed refrigerant increases in the second evaporator 160 corresponding to the refrigerating compartment, and thus, fear of overcooling in the refrigerating compartment may be reduced. When the single refrigerant or the azeotropic mixed refrigerant is used, the temperature is the same in the evaporation process. Therefore, supercooling in the second evaporator 160 may be avoided.

A first capillary tube 140 may be provided in a connection passage of the first evaporator 150 among discharge sides of the three-way valve 130. A second capillary tube 145 may be provided in a connection passage of the second evaporator 160 among discharge sides of the three-way valve 130. Each of the capillary tubes 140 and 145 may be referred to as an "expander".

The first capillary tube 140 may expand the non-azeotropic mixed refrigerant to supply the refrigerant to the first evaporator 150. The second capillary tube 145 may expand the non-azeotropic mixed refrigerant to supply the refrigerant to the second evaporator 160.

A refrigerant outlet side of the first evaporator 150 may be connected to a refrigerant inlet side of the second evaporator 160. The refrigerant outlet side of the first evaporator 150 may be connected to a refrigerant outlet side of the second capillary tube 145.

A check valve 155 may be provided in a connection pipe between the first evaporator 150 and the second evaporator 160, that is, immediately downstream of the first evaporator 150. The check valve 155 may allow refrigerant flow from the first evaporator 150 to the second evaporator 160 and may not allow reverse flow in an opposite direction. Therefore, reverse flow of the refrigerant may be prevented when switching from simultaneous operation of the freezer compartment and the refrigerating compartment to operation of the refrigerating compartment alone.

A gas-liquid separator may not be suitable to be installed in the connection pipe between the first evaporator 150 and the second evaporator 160. This is because if only gas is passed in the non-azeotropic mixed refrigerant that has only partially evaporated in the first evaporator 150, sufficient cooling power may not be supplied to the second evaporator 160. In other words, the non-azeotropic mixed refrigerant may not maintain the mixing ratio of the two refrigerants in the liquid phase and the gas phase.

The gas-liquid separator 165 may be provided at the outlet side of the second evaporator 160. The gas-liquid separator 165 allows only the gas refrigerant to be discharged to the compressor 110, thereby preventing damage and noise of the compressor 110 and improving efficiency.

A compressor suction pipe 170, which connects the second evaporator 160 to the compressor 110, and the capillary tubes 140 and 145 may exchange heat with each other. Therefore, heat of the capillary tubes 140 and 145 may be transferred to the compressor suction pipe 170, such that refrigerant introduced into the compressor 110 may maintain a gas state. The cold air of the compressor suction pipe 170 may be transferred to the capillary tubes 140 and 145 to prevent cold air loss and reduce power consumption.

The compressor suction pipe 170 may exchange heat with at least one of the capillary tubes 140 and 145. In the simultaneous operation of the freezer compartment and the refrigerating compartment and the operation of the freezer compartment alone, the compressor suction pipe 170 and the first capillary tube 140 may exchange heat with each other. In the operation of the refrigerating compartment alone, the compressor suction pipe 170 and the second capillary tube 145 may exchange heat with each other. Therefore, cold air loss may be reduced in each mode and efficiency of the refrigeration cycle may be increased.

The compressor suction pipe 170 may exchange heat with both of the capillary tubes 140 and 145. Therefore, cold air loss may be reduced in all operation modes. The compressor suction pipe 170, the first capillary tube 140, and the second capillary tube 145 may be provided at positions adjacent to each other to exchange heat with each other.

The serial bypass 1-compression 2-evaporation system has at least the following advantages. First, the gliding temperature difference of the non-azeotropic mixed refrigerant is provided in the order of the freezer compartment and the refrigerating compartment, thereby reducing irreversible loss and reducing power consumption. Second, operation of the refrigerating compartment alone, operation of the freezer compartment alone, and simultaneous operation of the freezer compartment and the refrigerating compartment may all be stably performed.

As the refrigerant of embodiments, the non-azeotropic mixed refrigerant, the temperature of which rises during evaporation, is used. Therefore, a temperature at outlet sides of the capillary tubes 140 and 145 may be higher than a temperature at an outlet side of the second evaporator 160. Due to this, a heat exchange reversal phenomenon may occur. The heat exchange reversal phenomenon will be described hereinafter.

FIG. 6 is a schematic view of the evaporator and the capillary tubes, showing temperature of each point. Temperature reversal of the regenerative heat exchanger in the case of using the non-azeotropic mixed refrigerant will be described with reference to FIG. 6.

FIG. 6 shows the first evaporator 150, the second evaporator 160, and the regenerative heat exchanger 180 in which heat exchange between the compressor suction pipe 170 and the capillary tubes 140 and 145 is performed. FIG. 6 shows simultaneous operation of the freezer compartment and the refrigerating compartment.

Each point on the drawing is marked with a P, the first number 1 after the P represents the inlet side of the first capillary tube, and the first number 2 after the P represents the inlet side of the compressor suction line. The second number after the P represents an order of progress.

The refrigerant introduced through the inlet of the first capillary tube 140 flows through passages of points P11, P12, P13, and P14. The refrigerant introduced through the inlet of the compressor suction pipe 170 flows through passages of points P21 and P22. The regenerative heat exchanger 180 may correspond to a zone indicated by an arrow.

A temperature of the refrigerant flowing through the first capillary tube 140 in the region of the regenerative heat exchanger 180 drops from 31° C. to −27° C. (P11→P12). A temperature of the refrigerant flowing through the compressor suction pipe 170 in the region of the regenerative heat exchanger 180 rises from 0° C. to 25° C. (P21→P22). Therefore, a heat exchange reversal region in which heat exchange between the capillary tube and the compressor suction pipe is reversed may occur in the region of the regenerative heat exchanger 180.

The heat exchange reversal region may be a factor that decreases efficiency of heat exchange and increases power consumption. In the drawing, the vertically extending arrow schematically indicates a region in which the regenerative heat exchanger 180 is provided.

The refrigerant passing through the point P12 may pass through the first evaporator 150. When the refrigerant passes through the first evaporator 150, the refrigerant is discharged at −20° C. from the point P13 and is introduced into the second evaporator 160. The refrigerant further evaporated by the second evaporator 160 is discharged at 0° C. from the point P14 at the outlet side of the second evaporator 160. The point P14 and the point P21 may be 0° C. as the same point.

FIG. 7 is a schematic view of temperature change in a refrigerant pipe and compressor suction pipe in the regenerative heat exchanger. Referring to FIG. 7, the heat exchange direction is reversed at a point T. It can be seen that the heat exchange reversal region is after the point T based on the progress direction of the capillary tubes.

In the heat exchange reversal region, cold air from the capillary tubes is transferred toward the compressor suction pipe. This phenomenon causes loss of heat exchange in the evaporator, and thus, should be avoided.

The refrigerating system may be reconfigured to remove the heat exchange reversal region, but this is difficult in terms of common use of production facilities and components. The structure in which the heat exchange reversal region itself disappears in the regenerative heat exchanger will be described hereinafter.

FIG. 8 is a partial view of a refrigerating system, in which a regenerative heat exchanger is exaggerated. Referring to FIG. 8, the regenerative heat exchanger 180 is shown with a dashed line. In the regenerative heat exchanger (SLHX: Suction Line Heat Exchanger), heat exchange may be performed in such a manner that the capillary tube and the compressor suction pipe come into contact with each other or are adjacent to each other.

Under the control of the three-way valve 130, the refrigerant may flow into at least one of the first capillary tube 140 or the second capillary tube 145. In the drawing, the refrigerant passing through the capillary tubes 140 and 145 may flow from top to bottom, that is, downward. The refrigerant discharged from the second evaporator 160 may flow through the compressor suction pipe 170. In the drawing, the refrigerant flowing through the compressor suction pipe 170 may flows from bottom to top, that is, upward. As the drawing is for convenience of understanding, the direction may be left and right.

The refrigerant flowing through the capillary tube and the refrigerant flowing through the compressor suction pipe flow counterflow and exchange heat with each other. As described above, the heat exchange reversal region may occur in the regenerative heat exchanger 180. Therefore, for the heat exchange reversal region, the refrigerant in the capillary tube and the refrigerant in the compressor suction pipe may not exchange heat with each other.

Based on the drawing, the regenerative heat exchanger 180 forms a heat exchange region A1 in which heat exchange is performed at an upper portion of point T, and a shielding region A2 in which heat exchange is shielded at a lower portion of point T. The heat exchange region A1 may be a geometric region from point T to the three-way valve. The shielding region A2 may be a geometric region from point T to the evaporator.

The temperature at the point T may fluctuate according to operating conditions of the cycle of the refrigerating system. The temperature at the point T may be within a range of −5° C. to 5° C.

A pipe length L1 of the shielding region A2 may be about 1 m. The point T may be placed at about 1 m from the outlet of the capillary tube and the inlet of the compressor suction pipe. That is, the shielding region may be included within about 1 m or less from the outlet of the capillary tube and the inlet of the compressor suction pipe.

In the shielding region A2, two pipe conduits may not come into contact with each other in order to shield heat exchange between the outlet of the capillary tube and the compressor suction pipe. For example, the two pipe conduits may not be welded together. In contrast, in the heat exchange region A1, two pipe conduits may be brought into contact with each other by a method, such as welding. However, in order to allow uniform heat exchange to be performed in the regenerative heat exchanger, indirect heat exchange with low heat exchange performance may be performed. In this case, it may be advantageous to prevent all the pipe conduits from being brought into contact with each other by a method, such as welding.

Due to the gliding temperature difference of the non-azeotropic mixed refrigerant, the heat exchange reversal region occurs not only in the serial bypass 1-compression 2-evaporation system, but also in the parallel 1-compression 2-evaporation system. Therefore, the shielding region A2 may be provided in the regenerative heat exchanger of the refrigerating system to which the non-azeotropic mixed refrigerant is applied. The parallel 1-compression 2-evaporation system may refer to a system in which an evaporator supplying cold air to the freezer compartment and an evaporator supplying cold air to the refrigerating compartment are connected in parallel to supply cold air to the freezer compartment and the refrigerating compartment.

Generation of a heat exchange reversal region in a parallel 1-compression 2-evaporation system will be described with reference to FIGS. 9 and 10.

FIG. 9 is a schematic view of an evaporator and a capillary tubes in a parallel 1-compression 2-evaporation system. FIG. 10A is a temperature graph explaining a heat exchange reversal region in a parallel 1-compression 2-evaporation system when a single refrigerant is used. FIG. 10B is a temperature graph explaining heat exchange reversal region in a parallel 1-compression 2-evaporation system when the non-azeotropic mixed refrigerant is used.

Referring to FIG. 9, the parallel 1-compression 2-evaporation system may include a refrigerant supplier 190 that branches the condensed refrigerant to two evaporators, and first evaporator 150 and second evaporator 160 that evaporate the refrigerant supplied from the refrigerant supplier 190 and supply cold air. The first evaporator 150 may be an evaporator that supplies cold air to the freezer compartment, and the second evaporator 160 may be an evaporator that supplies cold air to the refrigerating compartment.

As the refrigerant is the non-azeotropic mixed refrigerant, the temperature of the non-azeotropic mixed refrigerant rises due to the gliding temperature difference during evaporation. Therefore, the shielding region A2 may be provided in the regenerative heat exchanger 180.

It can be seen that there is no heat exchange reversal region in FIG. 10A, but the heat exchange reversal region is generated in FIG. 10B. As a result, in the case of the refrigerating system provided with the non-azeotropic mixed refrigerant and the regenerative heat exchanger, the shielding region is provided in the regenerative heat exchanger, thereby reducing power consumption.

INDUSTRIAL APPLICABILITY

According to embodiments disclosed herein, when a non-azeotropic mixed refrigerant is used, a refrigerating system that implements various operation modes and improves a coefficient of performance may be provided.

The invention claimed is:

1. A refrigerating apparatus, comprising:

a compressor to compress a non-azeotropic mixed refrigerant;

a condenser to condense the compressed non-azeotropic mixed refrigerant;

a valve to branch the non-azeotropic mixed refrigerant condensed by the condenser;

a first evaporator to supply cold air to a first interior space;

a second evaporator to supply cold air to a second interior space at a temperature higher than a temperature of the first interior space;

at least one capillary tube to expand the non-azeotropic mixed refrigerant branched by the valve and to supply the expanded non-azeotropic mixed refrigerant to at least one of the first evaporator or the second evaporator; and a shielding region in which a first portion of the compressor suction pipe and a second portion of the at least one capillary tube are shielded from each other and the non-azeotropic mixed refrigerant flowing through the first portion of the compressor suction pipe does not exchange heat with the non-azeotropic mixed refrigerant flowing through the second portion of the at least one capillary tube.

2. The refrigerating apparatus according to claim 1, comprising a heat exchange region in which a third portion of the first capillary tube exchanges the heat with a fourth portion of the compressor suction pipe.

3. The refrigerating apparatus according to claim 2, comprising a compressor suction pipe to connect the refrigerant outlet side of the second evaporator to an inlet side of the compressor.

4. The refrigerating apparatus according to claim 3, wherein a gas-liquid separator is disposed at the compressor suction pipe.

5. The refrigerating apparatus according to claim 3, wherein the at least one capillary tube comprises:

a first capillary tube to connect the valve to a refrigerant inlet side of the first evaporator; and a second capillary tube to connect the valve to the refrigerant inlet side of the second evaporator.

6. The refrigerating apparatus according to claim 5, comprising a regenerative heat exchanger in which at least one of a third portion of the first capillary tube or a fourth portion of the second capillary tube is adjacent to a fifth portion of the compressor suction pipe to exchange heat therewith.

7. The refrigerating apparatus according to claim 6, wherein the regenerative heat exchanger comprises:

a heat exchange region in which at least one of the third portion of the first capillary tube or the fourth portion of the second capillary tube exchanges the heat with the fifth portion of the compressor suction pipe; and the shielding region in which at least one of the second portion of the first capillary tube or a sixth portion of the second capillary tube is shielded so as not to exchange the heat with the first portion of the compressor suction pipe.

8. The refrigerating apparatus according to claim 7, wherein the shielding region is an area having a distance from a point to an end of the regenerative heat exchanger, the point being a point at which a temperature of the non-azeotropic mixed refrigerant flowing through the respective capillary tube is lower than a temperature of the non-azeotropic mixed refrigerant flowing through the compressor suction pipe.

9. The refrigerating apparatus according to claim 8, wherein the temperature at the point is in a range of −5° C. to 5° C.

10. The refrigerating apparatus according to claim 7, wherein the distance of the shielding region is 1 m or less from an outlet of the respective capillary tube or an inlet of the compressor suction pipe.

11. The refrigerating apparatus according to claim 1, wherein a refrigerant outlet side of the first evaporator is connected to a refrigerant inlet side of the second evaporator by a connection pipe, and the connection pipe includes a check valve to allow the non-azeotropic mixed refrigerant to flow from the first evaporator to the second evaporator.

12. The refrigerating apparatus according to claim 1, wherein the non-azeotropic mixed refrigerant includes isobutane and propane.

13. The refrigerating apparatus according to claim 1, wherein the first interior space is a freezer compartment and the second interior space is a refrigerating compartment.

14. A refrigerating apparatus, comprising:

a compressor to compress a non-azeotropic refrigerant;

a condenser to condense the compressed non-azeotrpoic mixed refrigerant;

an expander to expand the condensed non-azeotropic mixed refrigerant;

at least one evaporator to evaporate the expanded non-azeotropic mixed refrigerant to supply cold air, and discharge the evaporated non-azeotropic mixed refrigerant through a compressor suction pipe to the compressor; and a shielding region in which a first portion of the compressor suction pipe and a second portion of the expander are shielded from each other and the non-azeotropic mixed refrigerant flowing through the first portion of the compressor suction pipe does not exchange heat with the non-azeotropic mixed refrigerant flowing through the second portion of the expander.

15. The refrigerating apparatus of claim 14, wherein the at least one evaporator comprises a freezer compartment evaporator connected in series with a refrigerating compartment evaporator.

16. The refrigerating apparatus according to claim 14, comprising:

a regenerative heat exchanger to exchange heat between the non-azeotropic mixed refrigerant discharged from the at least one evaporator and the non-azeotropic mixed refrigerant flowing through the expander, wherein the regenerative heat exchanger comprises:

a heat exchange region in which a third portion of the compressor suction pipe and a fourth portion of the expander are adjacent to each other and the non-azeotropic mixed refrigerant flowing through the third portion of the compressor suction pipe exchanges the heat with the non-azeotropic mixed refrigerant flowing through the fourth portion of the expander.

17. The refrigerating apparatus according to claim 16, wherein the refrigerating apparatus is controlled to operate in a mode in which the non-azeotropic mixed refrigerant is supplied by the valve to an upstream evaporator among the first evaporator and the second evaporator, such that the first evaporator and the second evaporator supply cold air.

18. The refrigerating apparatus according to claim 17, wherein the refrigerating apparatus is controlled to operate in a mode in which the upstream evaporator among the first evaporator and the second evaporator supplies cold air of a temperature lower than a downstream evaporator among the first evaporator and the second evaporator.

19. The refrigerating apparatus according to claim 17, wherein the refrigerating apparatus is controlled to operate in a mode in which a downstream evaporator among the first evaporator and the second evaporator does not supply cold air.

20. The refrigerating apparatus according to claim 16, wherein the refrigerating apparatus is controlled to operate in a mode in which only one of the first evaporator and the second evaporator supplies cold air.

21. The refrigerating apparatus according to claim 20, wherein the refrigerating apparatus is controlled to operate in a mode in which the non-azeotropic mixed refrigerant is directly supplied to a downstream evaporator among the first evaporator and the second evaporator.

22. The refrigerating apparatus according to claim 16, wherein the expander is disposed at a refrigerant inlet side of each of the first evaporator and the second evaporator.

23. The refrigerating apparatus according to claim 16, wherein the first evaporator and the second evaporator include a freezer compartment evaporator in series with a refrigerating compartment evaporator.

* * * * *